US007755273B2

(12) United States Patent
Chung et al.

(10) Patent No.: US 7,755,273 B2
(45) Date of Patent: Jul. 13, 2010

(54) FIELD EMISSION DEVICE AND ITS METHOD OF MANUFACTURE

(75) Inventors: Deuk-seok Chung, Yongin-si (KR); Yong-chul Kim, Yongin-si (KR); Yong-wan Jin, Yongin-si (KR); Sun-il Kim, Yongin-si (KR); Ho-suk Kang, Yongin-si (KR); Chan-wook Baik, Yongin-si (KR)

(73) Assignee: Samsung Electronics Co., Ltd. (KR)

( * ) Notice: Subject to any disclaimer, the term of this patent is extended or adjusted under 35 U.S.C. 154(b) by 601 days.

(21) Appl. No.: 11/798,612

(22) Filed: May 15, 2007

(65) Prior Publication Data

US 2008/0111464 A1 May 15, 2008

(30) Foreign Application Priority Data

Nov. 13, 2006 (KR) ..... 10-2006-0111891

(51) Int. Cl.
*H01J 1/62* (2006.01)

(52) U.S. Cl. ..... 313/497; 313/495; 445/24

(58) Field of Classification Search ..... 313/495–497; 445/24–25

See application file for complete search history.

(56) References Cited

U.S. PATENT DOCUMENTS

2004/0066132 A1 * 4/2004 Cho et al. ..... 313/495
2005/0116612 A1 * 6/2005 Oh ..... 313/497
2007/0114910 A1 * 5/2007 Yang et al. ..... 313/495

* cited by examiner

*Primary Examiner*—Nimeshkumar D. Patel
*Assistant Examiner*—Mary Ellen Bowman
(74) *Attorney, Agent, or Firm*—Cantor Colburn LLP

(57) ABSTRACT

A field emission device and its method of manufacture includes: a substrate; a plurality of cathode electrodes formed on the substrate and having slot shaped cathode holes to expose the substrate; emitters formed on the substrate exposed through each of the cathode holes and separated from both side surfaces of the cathode holes, the emitters being formed along a lengthwise direction of the cathode holes; an insulating layer formed on the substrate to cover the cathode electrodes and having insulating layer holes communicating with the cathode holes; and a plurality of gate electrodes formed on the insulating layer and having gate holes communicating with the insulating layer holes.

25 Claims, 10 Drawing Sheets

FIELD EMISSION DEVICE AND ITS METHOD OF MANUFACTURE

CLAIM OF PRIORITY

This application makes reference to, incorporates the same herein, and claims all benefits accruing under 35 U.S.C. §119 from an application for FIELD EMISSION DEVICE AND METHOD OF A MANUFACTURING THE SAME earlier filed in the Korean Intellectual Property Office on Nov. 13, 2006 and there duly assigned Serial No. 10-2006-0111891.

BACKGROUND OF THE INVENTION

1. Field of the Invention

The present invention relates to a Field Emission Device, and more particularly, the present invention relates to a Field Emission Device having an emitter structure that can increase uniformity of electron emission and reduce a driving voltage and a method of manufacturing the field emission device.

2. Description of the Related Art

A Field Emission Device emits electrons from emitters formed on a cathode electrode by forming a strong electric field around the emitters. An example of an application of the Field Emission Device is a Field Emission Display (FED), which displays an image using visible light emitted from the collision of electrons emitted from the Field Emission Device to a phosphor layer formed on an anode electrode. Due to the excellent characteristics of FEDs such as thinness, that is, an overall thickness of a FED is only a few centimeters, a large viewing angle, low power consumption, and low manufacturing costs, FEDs are expected to be one of the next generation display devices together with Liquid Crystal Displays (LCDs) and Plasma Display Panels (PDPs).

A Field Emission Device can also be used in a BackLight Unit (BLU) of an LCD that displays an image on a front surface of the LCD when light emitted from a light source located in the rear of the LCD is transmitted through liquid crystals that control the rate of optical transmittance of light. The light source located in the rear of the LCD can be a Cold Cathode Fluorescence Lamp (CCFL), an External Electrode Fluorescence Lamp (EEFL), or a Light Emitting Diode (LED). Besides these, a field emission backlight unit can also be used as the light source.

The field emission backlight unit in principle has an identical driving mechanism and a light emission mechanism as the Field Emission Device. However, the difference is that the field emission backlight unit does not display an image but only functions as a light source. Due to its thinness, low manufacturing costs, and location selective brightness control function, the field emission backlight unit is expected to be a next generation backlight unit for LCDs. These field emission devices can also be applied to various other systems that use electron emission, such as X-ray tubes, microwave amplifiers, flat panel lamps, and the like.

A micro tip formed of a metal, such as molybdenum Mo, is used as an emitter that emits electrons in a Field Emission Device. However, recently, Carbon NanoTubes (CNTs) having high electron emission characteristics are mainly used as emitters. Field Emission Devices that use CNT emitters have advantages of low manufacturing costs, a low driving voltage, and high chemical and mechanical stability. The CNT emitters can be formed by forming CNTs in a paste form or by directly growing the CNTs using a Chemical Vapor Deposition (CVD) method. However, due to a high growing temperature and complicated synthesizing conditions of the direct growing method, mass production is difficult. Therefore, recently, the method that forms the CNTs in a paste form is mainly used.

FIG. 1 is a plan view of a conventional field emission device, and FIG. 2 is a cross-sectional view taken along line II-II' of FIG. 1. Referring to FIGS. 1 and 2, the conventional field emission device has a structure in which a plurality of cathode electrodes 12, an insulating layer 14, and a plurality of gate electrodes 16 are sequentially stacked on a substrate 10. The gate electrodes 16 cross the cathode electrodes 12. A plurality of insulating layer holes 15 that expose the cathode electrodes 12 are formed in the insulating layer 14, and a plurality of gate holes 17 that are connected to the insulating layer holes 15 are formed in the gate electrodes 16. Emitters 30 for emitting electrons are formed on the cathode electrodes 12 in each of the insulating layer holes 15. The emitters 30 can be formed of Carbon Nano Tubes (CNTs). In this structure, electrons are emitted from the emitters 30 when a strong electric field is formed between the emitters 30 and the gate electrodes 16.

In the conventional field emission device as described above, the emitters 30 can be formed in a small dot shape having a diameter of approximately 6 μm in each of the insulating layer holes 15 by patterning a CNT paste using a sacrificial layer formed of a photoresist. However, in the method of forming the emitters 30 that are dot shaped, it is difficult to form uniformly shaped emitters 30 by injecting the CNT paste into the insulating layer holes 15. Also, the uniformity of electron emission of the emitters 30 is reduced due to an interface reaction between the CNT paste and the photoresist.

SUMMARY OF THE INVENTION

The present invention provides a field emission device having an emitter structure that increases uniformity of electron emission and reduces a driving voltage and a method of manufacturing the field emission device.

According to an aspect of the present invention, a field emission device is provided including: a substrate; a plurality of cathode electrodes formed on the substrate and having slot shaped cathode holes to expose the substrate; emitters formed on the substrate exposed through each of the cathode holes and separated from both side surfaces of the cathode holes and formed along a lengthwise direction of the cathode holes; an insulating layer formed on the substrate to cover the cathode electrodes and having insulating layer holes connected to the cathode holes; and a plurality of gate electrodes that formed on the insulating layer and having gate holes connected to the insulating layer holes.

The substrate may be formed of an insulating material. The substrate may be a glass substrate or a plastic substrate.

The insulating layer holes and the gate holes may have shapes corresponding to that of the cathode holes. The emitter may be formed of Carbon NanoTubes (CNTs).

Both ends of each of the emitters may contact the cathode electrode or be separated from the cathode electrodes.

According to another aspect of the present invention, a method of manufacturing a field emission device is provided, the method including: forming a plurality of cathode electrodes on a substrate, the plurality of cathode electrodes having slot shaped cathode holes to expose the substrate; sequentially forming an insulating layer having insulating layer holes connected to the cathode holes and a forming plurality of gate electrodes on the substrate on which the cathode electrodes are formed, the plurality of gate electrodes having gate holes connected to the insulating layer holes; forming a sacrificial layer to cover upper surfaces of the gate electrodes and sidewalls of the cathode holes, the insulating layer holes, and the cathode holes, and having sacrificial layer holes to expose the substrate inside of the cathode holes, the insulating layer holes, and the gate holes; forming emitters on the substrate in the sacrificial layer holes; and removing the sacrificial layer.

The sacrificial layer may be formed of a material having etch selectivity with respect to the cathode electrodes and the gate electrodes. The sacrificial layer may be formed of Mo or Al.

The sacrificial layer holes may be formed along a lengthwise direction of the cathode holes separated from both inner sidewalls of the cathode holes.

The emitters may be formed of Carbon NanoTubes (CNTs).

Forming the emitters may include: coating a CNT paste on the sacrificial layer to fill the sacrificial layer holes; and forming the emitters in the sacrificial layer holes by exposing and developing the CNT paste. The CNT paste may be exposed by a back side exposure using the sacrificial layer as a photomask.

Forming the cathode electrodes may include: depositing a cathode material layer on the substrate; and forming the cathode electrodes and the cathode holes by patterning the cathode material layer.

Forming the sacrificial layer may include: depositing a sacrificial material layer to cover the upper surfaces of the gate electrodes, and the cathode holes, the insulating layer holes, and the gate holes; and forming the sacrificial layer holes inside of cathode holes, the insulating layer holes, and the gate holes by patterning the sacrificial material layer.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
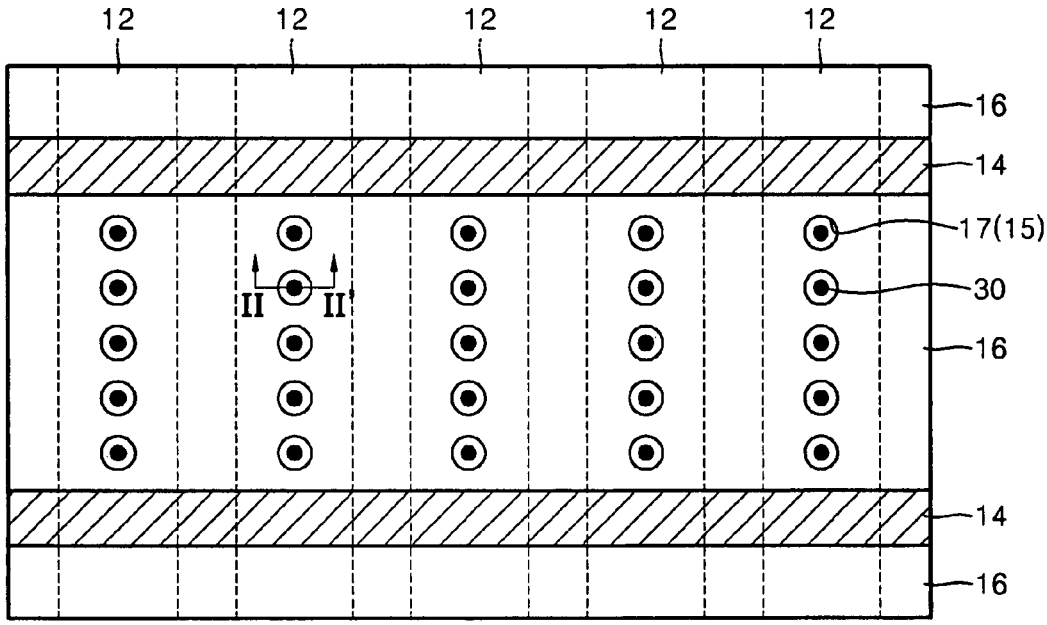
FIG. 1 (PRIOR ART)
FIG. 1 is a plan view of a conventional field emission device.
Figure 2:
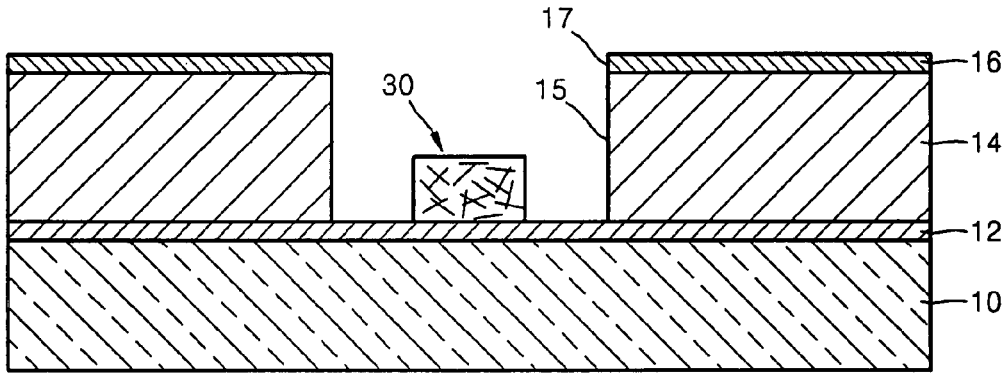
FIG. 2 (PRIOR ART)
FIG. 2 is a cross-sectional view taken along line II-II' of FIG. 1.

The present invention is described more fully below with reference to the accompanying drawings in which exemplary embodiments of the present invention are shown. In the drawings, the thicknesses of layers and regions are exaggerated for clarity, and like reference numerals refer to the like elements. Also, when a layer is referred to as being "on" another layer or substrate, it can be directly on the other layer or substrate, or intervening layers may also be present.

Figure 3:
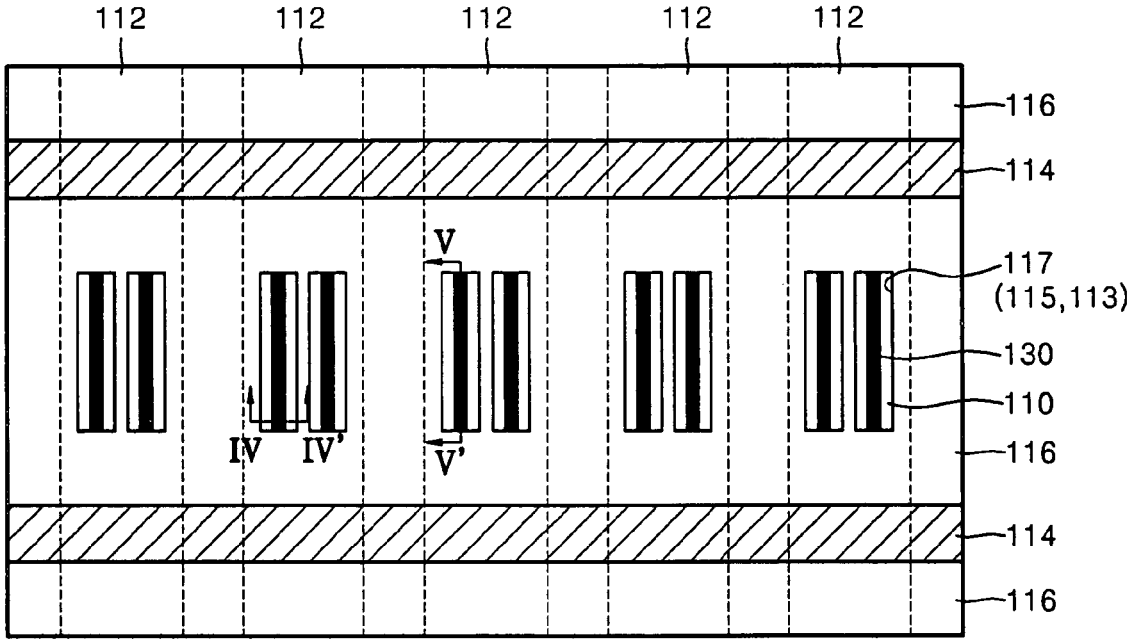
FIG. 3 is a plan view of a field emission device according to an embodiment of the present invention.
Figure 4:
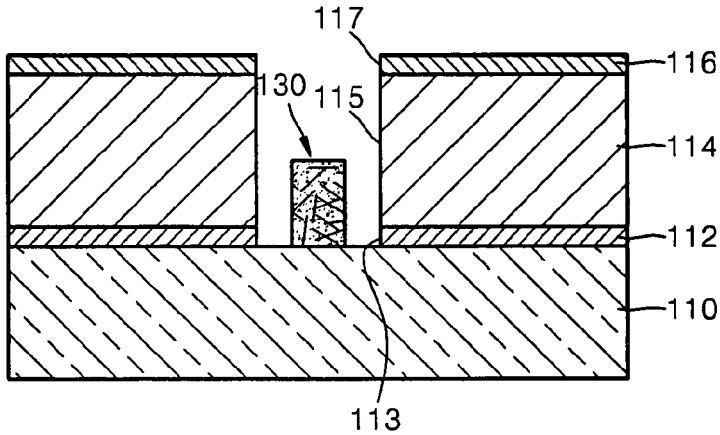
FIG. 4 is a cross-sectional view taken along line IV-IV' of FIG. 3, according to an embodiment of the present invention.
Figure 5:
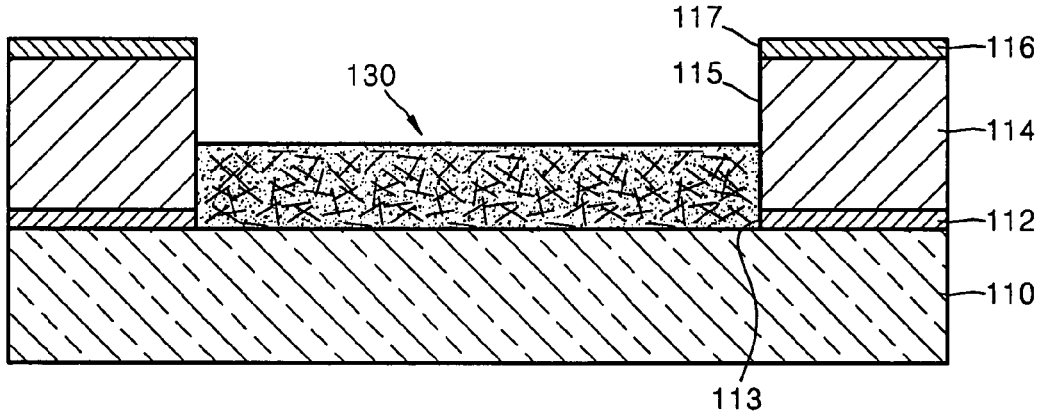
FIG. 5 is a cross-sectional view taken along line V-V' of FIG. 3, according to an embodiment of the present invention.
Figure 6:
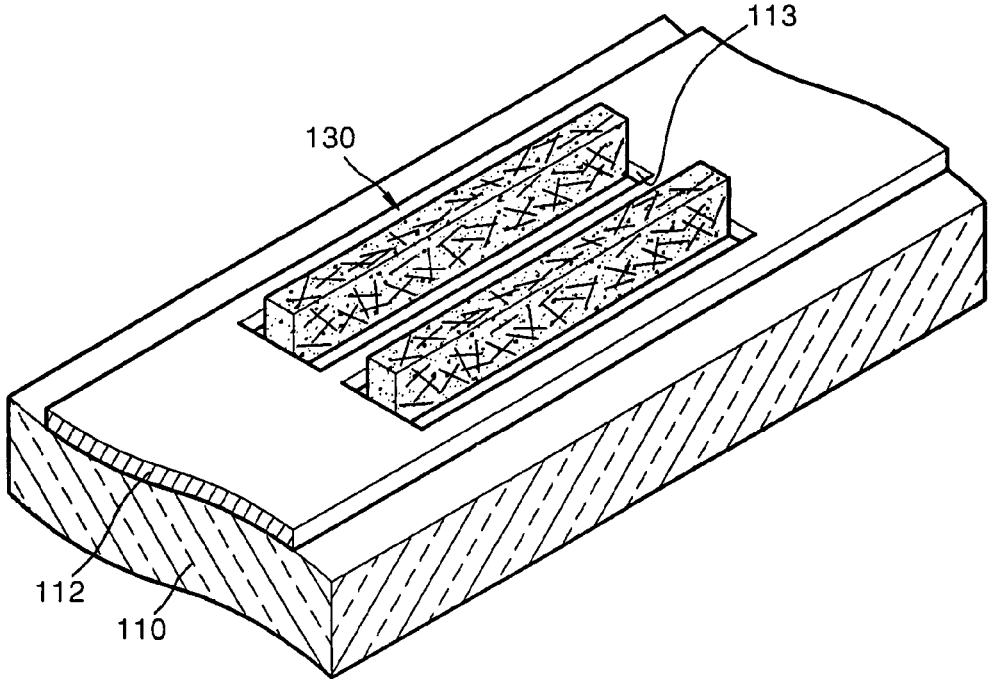
FIG. 6 is a perspective view of emitters formed on a substrate exposed through cathode holes in a field emission device, according to an embodiment of the present invention.

FIG. 3 is a plan view of a field emission device according to an embodiment of the present invention. FIG. 4 is a cross-sectional view taken along line IV-IV' of FIG. 3, according to an embodiment of the present invention, and FIG. 5 is a cross-sectional view taken along line V-V' of FIG. 3, according to an embodiment of the present invention. FIG. 6 is a perspective view of emitters 130 formed on a substrate 110 exposed through a plurality of cathode holes 113 that are slot shaped in the field emission device according to an embodiment of the present invention.

Referring to FIGS. 3 through 6, the field emission device according to an embodiment of the present invention has a structure in which a plurality of cathode electrodes 112, an insulating layer 114, and a plurality of gate electrodes 116 are sequentially stacked on the substrate 110. The gate electrodes 116 are formed to cross the cathode electrodes 112, and in this case, pixels are formed where the gate electrodes 116 cross the cathode electrodes 112.

The substrate 110 is formed of an insulating material. The substrate 110 can be a glass substrate or a plastic substrate. The cathode electrodes 112 are formed in a predetermined shape, for example, a stripe shape, on an upper surface of the substrate 110. As depicted in FIG. 6, the slot shaped cathode holes 113 that expose the substrate 110 are formed in the cathode electrodes 112. In FIG. 3, two cathode holes 113 are formed per pixel, but the present embodiment is not limited thereto. That is, one cathode hole or three or more cathode holes 113 can be formed per pixel. Also, in FIG. 3, the slot shaped cathode holes 113 are formed in parallel to the cathode electrodes 112, but the present embodiment is not limited thereto. That is, the slot shaped cathode holes 113 can be formed in various different directions. The cathode electrodes 112 can be formed of a metal, such as Cr, Ag, AL, or Au, or a transparent conductive material, such as Indium Tin Oxide (ITO). However the cathode electrodes 112 according to the present embodiment are not limited thereto.

The insulating layer 114 is formed on the substrate 110 to cover the cathode electrodes 112, and a plurality of insulating layer holes 115 that are connected to the cathode holes 113 are formed in the insulating layer 114. The insulating layer holes 115 can be formed in a shape corresponding to the cathode holes 113. The insulating layer holes 115 can be formed of, for example, a silicon oxide, or various other materials.

The gate electrodes 116 are formed in a predetermined shape, for example, a stripe shape, on an upper surface of the insulating layer 114. A plurality of gate holes 117 that are connected to the insulating layer holes 115 are formed in the gate electrodes 116. In the present embodiment, the gate holes 117 can be formed in a shape corresponding to the cathode holes 113 like the insulating layer holes 115. The gate electrodes 116 can be formed of a metal, such as Cr, Ag, Al, or Au, or a transparent conductive material, such as ITO. However, the gate electrodes 116 according to the present embodiment are not limited thereto.

The emitters 130 having a predetermined height are formed on the substrate 110 that is exposed through each of the cathode holes 113. In the present embodiment, the emitters 130 are separated from both side surfaces of the cathode holes 113 and are arranged in a lengthwise direction of the cathode holes 113. Both ends of each of the emitters 130 contact the cathode electrodes 112. The emitters 130 can be formed of Carbon NanoTubes (CNTs), and can have a size greater than conventional emitters having a diameter of approximately 6 μm. The emitters 130 can have, for example, a length of approximately 200 μm and a width of approximately 8 μm. However, the dimensions of the emitters 130 according to the present embodiment are not limited thereto, and the emitters 130 can have various other dimensions. As the size of the emitters 130 increases, the number of emitters 130 formed per pixel can be reduced as compared to the prior art.

In the field emission device according to the present embodiment, a predetermined voltage is respectively supplied to the cathode electrodes 112 and the gate electrodes 116 so that electrons are emitted from the emitters 130 due to a strong electric field that is formed between the emitters 130 formed of CNTs and the gate electrodes 116.

Generally, in a field emission device, there is an edge effect. That is, the emission of electrons increases at edge portions of the emitters. If the size of the emitters 130 is larger than that of the prior art and the number of the emitters 130 is reduced as compared to the prior art, there is a problem in that the edge effect is reduced, and as a result, a driving voltage increases. In the field emission device according to the present embodiment, to solve such problems, the emitters 130 are formed on the substrate 110 that is exposed through the slot shaped cathode holes 113, and also, the emitters 130 are formed such that the emitters 130 are separated from both side surfaces of the cathode holes 113. In this configuration, when the emitters 130 are formed on the substrate 110 of an insulating material and the substrate 110 around both sides of the emitters 130 is exposed through the cathode holes 113, the edge effect of the emitters 130 can be maximized, thereby reducing a driving voltage.

Figure 7:
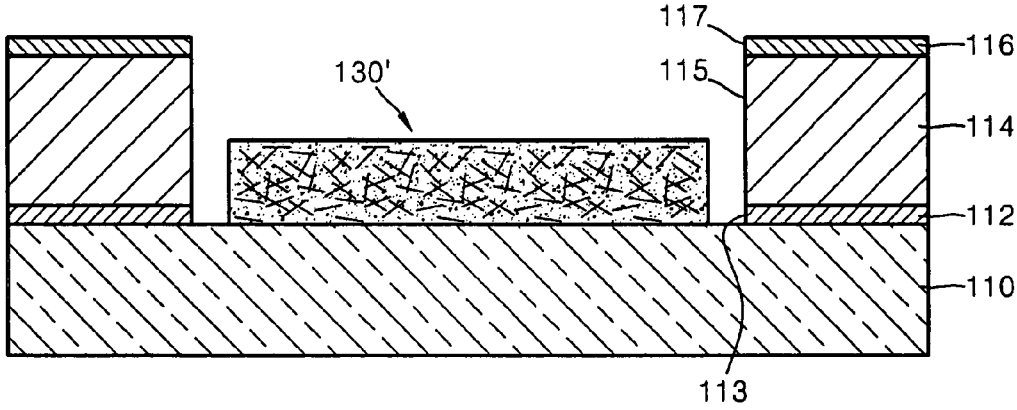
FIG. 7 is a cross-sectional view of a modified version of a field emission device according to another embodiment of the present invention.

FIG. 7 is a cross-sectional view of a modified version of a field emission device according to another embodiment of the present invention. Referring to FIG. 7, unlike the preceding embodiment, both ends of each of a plurality of emitters 130' are separated from the cathode electrodes 112. In the field emission device having the above structure, when a voltage is supplied to the cathode electrodes 112, a predetermined voltage is induced on the emitters 130' through the substrate 110 of an insulating material. Therefore, an electric field is formed between the emitters 130' and the gate electrodes 116, and as such, electrons are emitted from the emitters 130'.

Figure 8:
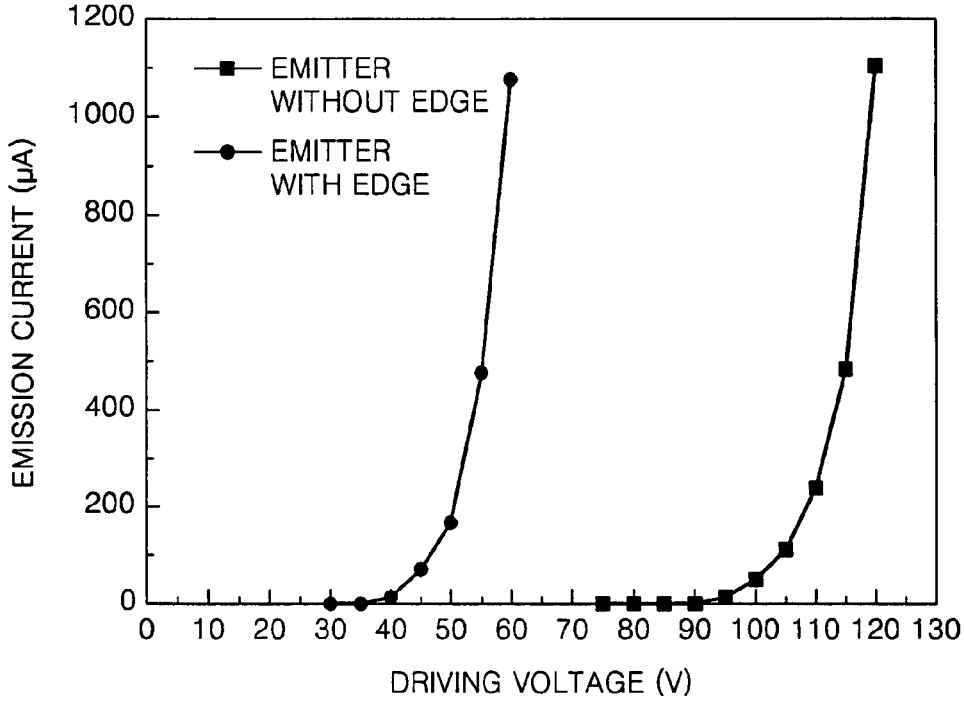
FIG. 8 is a graph of a comparison of electron emission characteristics of a field emission device when an emitter has edges and when an emitter does not have edges.

FIG. 8 is a graph of a comparison of electron emission characteristics of a field emission device with emitters having edges and with emitters not having edges. In FIG. 8, when the emitters 130 have edges denotes, like in the preceding embodiment, that the emitters 130 are formed on the substrate 110 exposed through each of the cathode holes 113 and the emitters 130 are separated from both side surfaces of the cathode hole 113, and when the emitters 130 do not have edges denotes that the emitters 130 are formed on the substrate 110 exposed through each of the cathode holes 113. However, both the emitters 130 are not separated from both side surfaces of the cathode hole 113. Referring to FIG. 8, when the emitters 130 have edges results in a driving voltage of almost a half as compared to when the emitters 130 do not have edges.

In the above embodiments, the field emission device only includes gate electrodes for extracting electrons. However, the present invention is not limited thereto. That is, the present invention can also be applied to a field emission device that includes gate electrodes for extracting electrons and a focusing electrode formed on the gate electrodes to focus the extracted electrons.

Hereinafter, a method of manufacturing a field emission device according to an embodiment of the present invention is described.

FIGS. 9A through 14B are cross-sectional views of the method of manufacturing a field emission device according to an embodiment of the present invention.

Figure 9A:
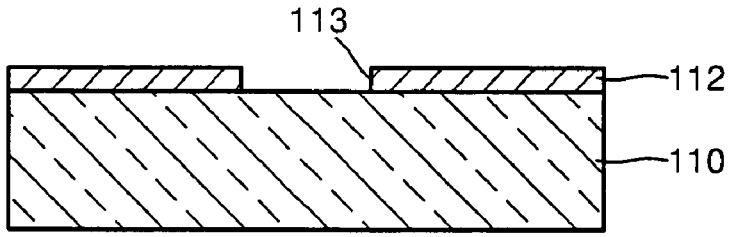
FIGS. 9A through 14B are cross-sectional views of a method of manufacturing a field emission device according to an embodiment of the present invention.
Figure 9B:
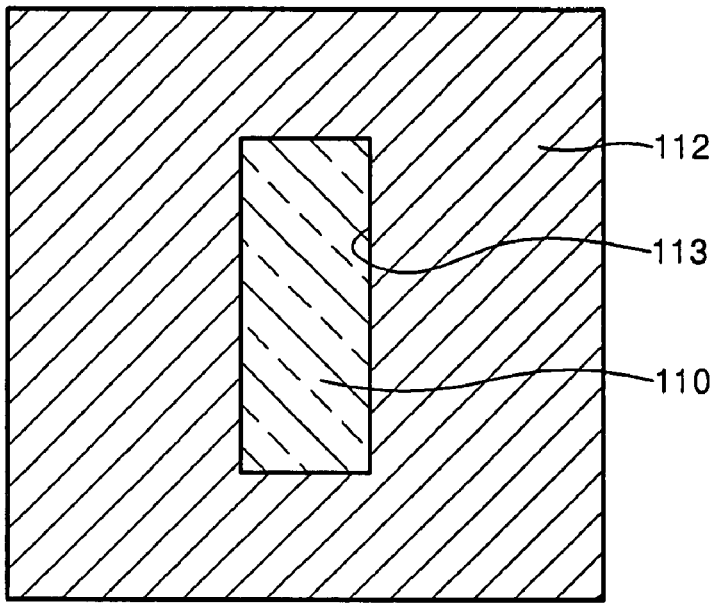

FIGS. 9A and 9B are respectively a cross-sectional view and a plan view of the cathode electrodes 112 formed on the substrate 110, according to an embodiment of the present invention. Referring to FIGS. 9A and 9B, the cathode electrodes 112 can be formed by patterning a cathode material layer (not shown) of a conductive material after depositing the conductive material on the substrate 110. Through the patterning process, the cathode electrodes 112 can be formed in a predetermined shape, for example, a stripe shape, on the substrate 110, and the slot shaped cathode holes 113 that expose the substrate 110 are formed in the cathode electrodes 112. The cathode electrodes 112 can be formed of a metal, such as Cr, Ag, Al, or Au, or a transparent conductive material, such as ITO. However the cathode electrodes 112 according to the present embodiment are not limited thereto.

Figure 10A:
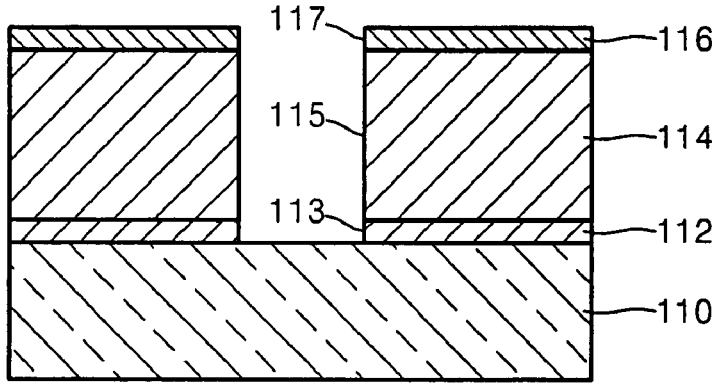
Figure 10B:
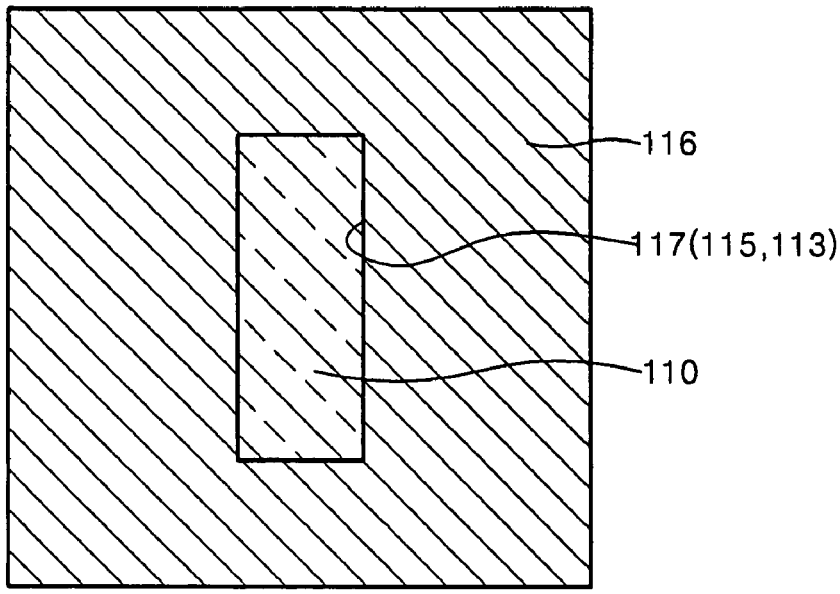

FIGS. 10A and 10B are respectively a cross-sectional view and a plan view of the insulating layer 114 and the gate electrodes 116 formed on the substrate 110 on which the cathode electrodes are formed, according to an embodiment of the present invention. Referring to FIGS. 10A and 10B, the insulating layer 114 covering the cathode electrodes 112 is formed to a predetermined height on the substrate 110. The insulating layer 114 can be formed of, for example, a silicon oxide, or can be formed of various other materials. After depositing a gate material layer (not shown) of a conductive material on an upper surface of the insulating layer 114, the gate material layer is patterned to a predetermined shape. Through the patterning process, the gate electrodes 116 are formed in a predetermined shape, for example, a stripe shape, on the upper surface of the insulating layer 114, and gate holes 117 having a shape corresponding to the cathode holes 113 are formed in the gate electrodes 116. At this point, the gate electrodes 116 can be formed to cross the cathode electrodes 112. The gate electrodes 116 can be formed of a metal, such as Cr, Ag, AL, or Au, or a transparent conductive material, such as ITO. However, the gate electrodes 116 according to the present embodiment are not limited thereto. Then, insulating layer holes 115 having a shape corresponding to the cathode holes 113 are formed in the insulating layer 114 by etching the insulating layer 114 exposed through the gate holes 117 until the substrate 110 is exposed. As a result, the substrate 110 is exposed through the gate holes 117, the insulating layer holes 115, and the cathode holes 113.

Figure 11A:
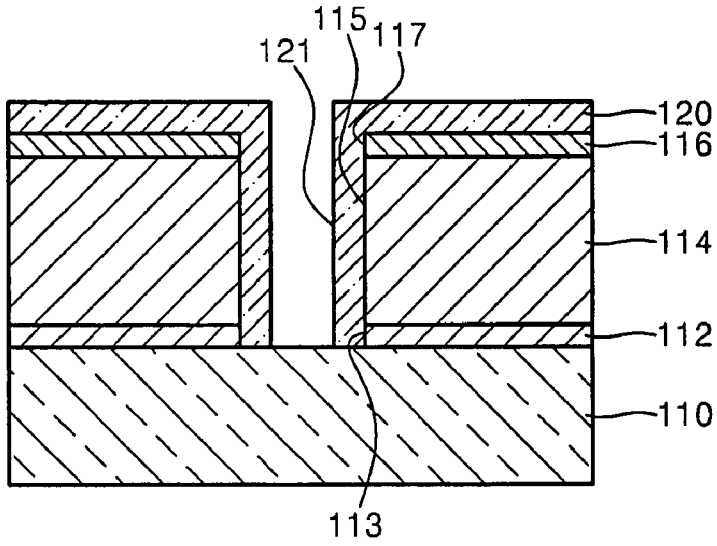
Figure 11B:
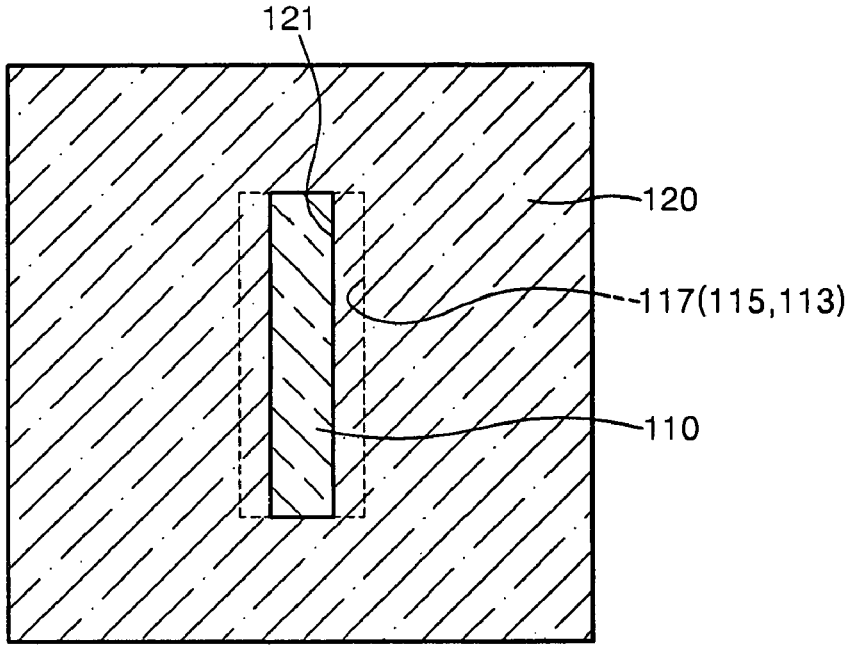

FIGS. 11A and 11B are respectively a cross-sectional view and a plan view of a sacrificial layer 120 formed on upper surfaces of the gate electrodes 116 and sidewalls of the gate holes 117, the insulating layer holes 115, and the cathode holes 113, according to an embodiment of the present invention. Referring to FIGS. 11A and 11B, a sacrificial material layer (not shown) is deposited to cover the upper surfaces of the gate electrodes 116, and the gate holes 117, the insulating layer holes 115, and the cathode holes 113. The deposition of the sacrificial material layer can be performed by sputtering or electron beam deposition. Then, the sacrificial layer 120 having a predetermined shape is formed by patterning the sacrificial material layer. Through the patterning of the sacrificial material layer, the sacrificial layer 120 covering the upper surfaces of the gate electrodes 116, and sidewalls of the gate holes 117, the insulating layer holes 115, and the cathode holes 113 is formed, and sacrificial layer holes 121 that expose the substrate 110 are formed inside of the gate holes 117, the insulating layer holes 115, and the cathode holes 113. In the present embodiment, the sacrificial layer holes 121 are separated from both side surfaces of the cathode holes 113 and formed along a lengthwise direction of the cathode holes 113. The sacrificial layer 120 may be formed of a material having etch selectivity with respect to the cathode electrodes 112 and the gate electrodes 116. The sacrificial layer 120 can be formed of, for example, Mo or alternatively Al. However the sacrificial layer 120 is not limited thereto. In more detail, the sacrificial layer 120 can be formed of various other materials that have etch selectivity with respect to the cathode electrodes 112 and the gate electrodes 116.

Figure 12:
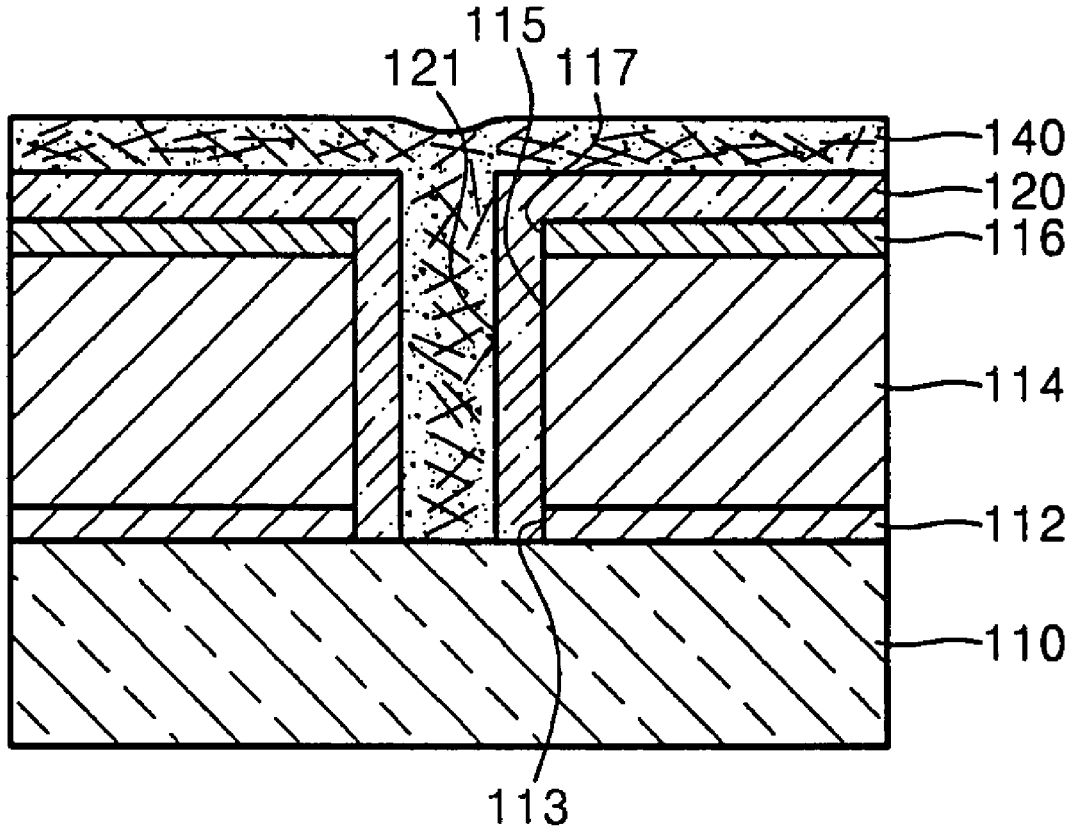

FIG. 12 is a cross-sectional view of a coating of a Carbon NanoTube (CNT) paste 140 on the sacrificial layer 120 to fill the sacrificial layer holes 121. Referring to FIG. 12, after preparing the CNT paste 140 by dispersing CNTs in a solvent in which a binder and a photoresist are mixed, the CNT paste 140 is coated on the sacrificial layer 120 to fill the sacrificial layer holes 121.

Figure 13A:
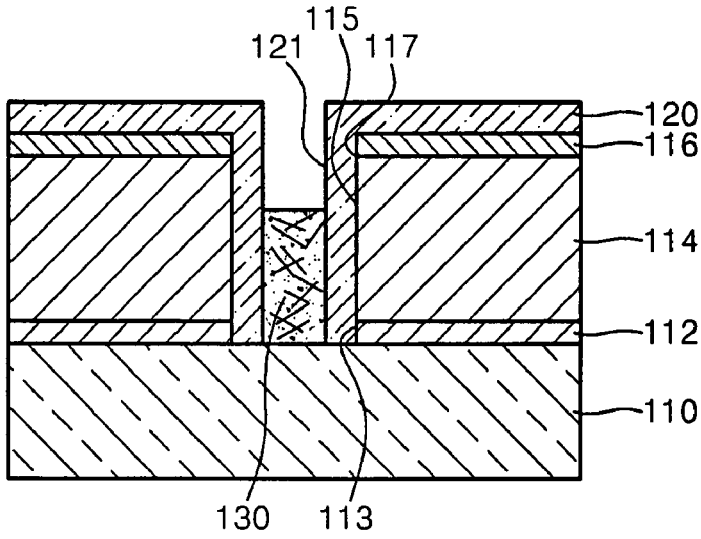
Figure 13B:
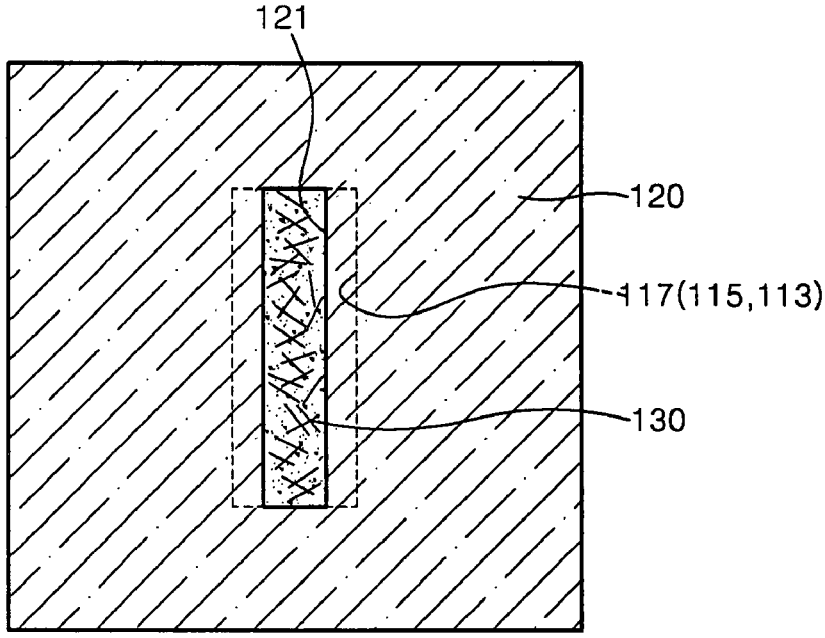

FIGS. 13A and 13B are respectively a cross-sectional view and a plan view of an exposed and developed state of the CNT paste 140, according to an embodiment of the present invention. Referring to FIGS. 13A and 13B, the CNT paste 140 can be exposed by aback side exposure. More specifically, when ultraviolet rays are radiated upon a lower side of the substrate 110 using the sacrificial layer 120 as a photomask, only the CNT paste 140 in the sacrificial layer holes 121 is exposed. Next, after removing the CNT paste 140 that has not been exposed due to developing, the remaining CNT paste 140 is baked at a constant temperature, as depicted in FIGS. 13A and 13B, and thus, the emitters 130 that are formed of CNTs having a predetermined height are formed on the substrate 110 exposed through the sacrificial layer holes 121.

Figure 14A:
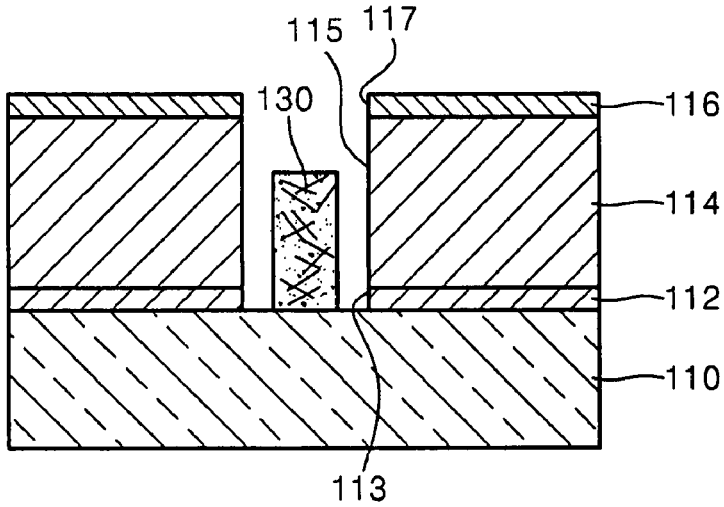
Figure 14B:
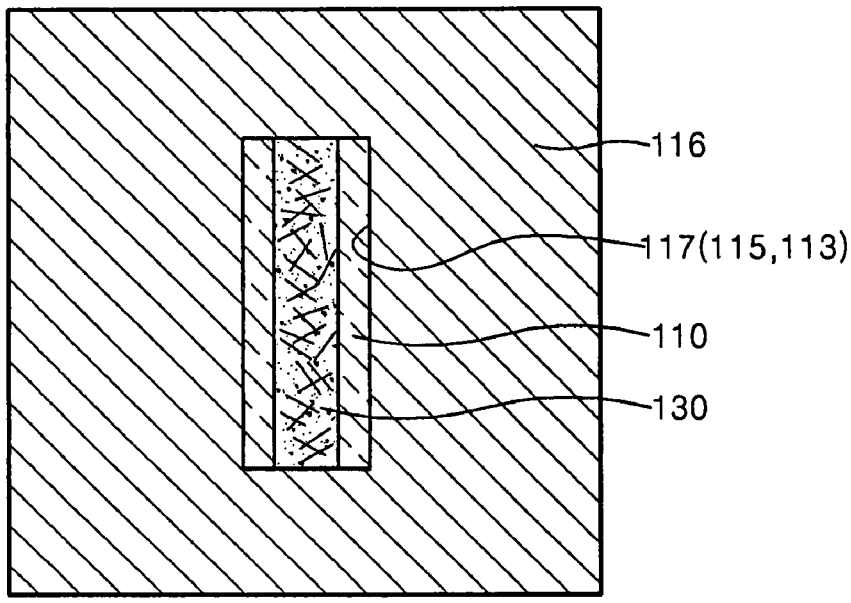

FIGS. 14A and 14B are respectively a cross-sectional view and a plan view of a state after the sacrificial layer 120 has been removed. Referring to FIGS. 14A and 14B, when the sacrificial layer 120 remaining on upper surfaces of the gate electrodes 116, and sidewalls of the gate holes 117, the insulating layer holes 115, and the cathode holes 113 is removed, the method of manufacturing of the field emission device according to the embodiment of the present invention is complete. As a result, the emitters 130 that are separated from both side surfaces of the cathode holes 113 and are formed along the lengthwise direction of the cathode holes 113 are formed on the substrate 110 that is exposed through the gate holes 117, the insulating layer holes 115, and the cathode holes 113.

In the present embodiment, both ends of the each of the emitters 130 contact the cathode electrodes 112. However, both ends of each of the emitters 130' can be formed to be separated from the cathode electrodes 112 as depicted in FIG. 7.

As described above, according to the present invention, when emitters are formed on a substrate of an insulating material and the substrate around both sides of the emitters is exposed through the cathode holes, an edge effect of the emitters can be maximized. As a result, a driving voltage can be reduced. Also, the uniformity of electron emission of the emitters can be increased since the emitters have a more uniform shape than the conventional dot shaped emitters.

While the present invention has been particularly shown and described with reference to exemplary embodiments thereof, it will be understood by those of ordinary skill in the art that various modifications in form and detail may be made therein without departing from the spirit and scope of the present invention as defined by the following claims.

What is claimed is:

1. A field emission device comprising:

a substrate;

a plurality of cathode electrodes arranged on the substrate, the plurality of cathode electrodes including slot shaped cathode holes to expose the substrate;

emitters arranged on the substrate exposed through each of the cathode holes and separated from both side surfaces of the cathode holes, the emitters being arranged along a lengthwise direction of the cathode holes;

an insulating layer arranged on the substrate to cover the cathode electrodes, the insulating layer including insulating layer holes communicating with the cathode holes; and a plurality of gate electrodes arranged on the insulating layer and including gate holes communicating with the insulating layer holes.

2. The field emission device of claim 1, wherein the substrate comprises an insulating material.

3. The field emission device of claim 1, wherein the substrate comprises either glass or plastic.

4. The field emission device of claim 1, wherein the insulating layer holes and the gate holes have shapes corresponding to that of the cathode holes.

5. The field emission device of claim 1, wherein the emitters comprise Carbon NanoTubes (CNTs).

6. The field emission device of claim 1, wherein both ends of each of the emitters contact the cathode electrodes.

7. The field emission device of claim 1, wherein both ends of each of the emitters are separated from the cathode electrodes.

8. The field emission device of claim 1, wherein the gate electrodes are arranged to cross the cathode electrodes.

9. The field emission device of claim 1, wherein the cathode electrodes and the gate electrodes comprise at least one of Cr, Ag, Al, Au, or Indium Tin Oxide (ITO).

10. A method of manufacturing a field emission device, the method comprising:

forming a plurality of cathode electrodes on a substrate, and forming slot shaped cathode holes in the plurality of cathode electrodes to expose the substrate;

sequentially forming an insulating layer having insulating layer holes communicating with the cathode holes and a plurality of gate electrodes having gate holes communicating with the insulating layer holes on the substrate on which the cathode electrodes have been formed;

forming a sacrificial layer to cover upper surfaces of the gate electrodes and sidewalls of the cathode holes, the insulating layer holes, and the cathode holes, the sacrificial layer having sacrificial layer holes to expose the substrate inside of the cathode holes, the insulating layer holes, and the gate holes;

forming emitters on the substrate in the sacrificial layer holes; and removing the sacrificial layer.

11. The method of claim 10, wherein the substrate is formed of an insulating material.

12. The method of claim 11, wherein the substrate is formed of either glass or plastic.

13. The method of claim 10, wherein the insulating layer holes and the gate holes are formed to have a shape corresponding to that of the cathode holes.

14. The method of claim 10, wherein the cathode electrodes and the gate electrodes are formed of at least one of Cr, Ag, Al, Au, or Indium Tin Oxide (ITO).

15. The method of claim 10, wherein the sacrificial layer is formed of a material having etch selectivity with respect to the cathode electrodes and the gate electrodes.

16. The method of claim 15, wherein the sacrificial layer is formed of either Mo or Al.

17. The method of claim 10, wherein the sacrificial layer holes are separated from both side surfaces of the cathode holes and are formed along a lengthwise direction of the cathode holes.

18. The method of claim 10, wherein the emitters are formed of Carbon NanoTubes (CNTs).

19. The method of claim 18, wherein forming the emitters comprises:

coating a CNT paste on the sacrificial layer to fill the sacrificial layer holes; and exposing and developing the CNT paste to form the emitters in the sacrificial layer holes.

20. The method of claim 19, wherein the CNT paste is exposed by a back side exposure using the sacrificial layer as a photomask.

21. The method of claim 10, wherein both ends of each of the emitters contact the cathode electrodes.

22. The method of claim 10, wherein both ends of each of the emitters are separated from the cathode electrodes.

23. The method of claim 10, wherein the gate electrodes are formed to cross the cathode electrodes.

24. The method of claim 10, wherein forming the cathode electrodes comprises:

depositing a cathode material layer on the substrate; and patterning the cathode material layer to form the cathode electrodes and the cathode holes.

25. The method of claim 10, wherein forming the sacrificial layer comprises:

depositing a sacrificial material layer to cover the upper surfaces of the gate electrodes, and the cathode holes, the insulating layer holes, and the gate holes; and patterning the sacrificial material layer to form the sacrificial layer holes inside of cathode holes, the insulating layer holes, and the gate holes by.

* * * * *